US007814762B2

(12) United States Patent
Kavchale et al.

(10) Patent No.: US 7,814,762 B2
(45) Date of Patent: Oct. 19, 2010

(54) INTEGRATED ICE DISPENSER SWITCH

(75) Inventors: Ravindra S. Kavchale, Madison, WI (US); Curtis L. Cruver, IV, Elmhurst, IL (US)

(73) Assignee: Sub-Zero, Inc., Madison, WI (US)

( * ) Notice: Subject to any disclaimer, the term of this patent is extended or adjusted under 35 U.S.C. 154(b) by 709 days.

(21) Appl. No.: 11/654,857

(22) Filed: Jan. 17, 2007

(65) Prior Publication Data

US 2008/0168782 A1 Jul. 17, 2008

(51) Int. Cl.
*B67D 5/62* (2006.01)

(52) U.S. Cl. ..... 62/344; 200/335; 222/146.6

(58) Field of Classification Search ..... 62/344; 200/329–335; 222/146.6, 505
See application file for complete search history.

(56) References Cited

U.S. PATENT DOCUMENTS

| | | | | |
|---|---|---|---|---|
| 4,220,266 | A | 9/1980 | Braden et al. | |
| 4,498,607 | A | 2/1985 | Jaschinski | |
| 4,628,699 | A | 12/1986 | Mawby et al. | |
| 4,662,182 | A | 5/1987 | Tsukiyama et al. | |
| 4,679,715 | A | 7/1987 | Hovinga | |
| 4,739,233 | A | 4/1988 | Marcade | |
| 4,835,978 | A | 6/1989 | Cole | |
| 5,033,273 | A | 7/1991 | Buchser et al. | |
| 5,119,639 | A | 6/1992 | Bein et al. | |
| 5,165,255 | A | 11/1992 | Alvarez et al. | |
| 5,211,462 | A | 5/1993 | Bien et al. | |
| 5,437,391 | A * | 8/1995 | Landers et al. | 222/1 |
| 5,442,933 | A | 8/1995 | Unger | |
| 5,473,911 | A | 12/1995 | Unger | |
| 5,718,121 | A | 2/1998 | Edwards et al. | |
| 5,860,564 | A * | 1/1999 | Jablonski | 221/303 |
| 5,886,430 | A | 3/1999 | Ralson et al. | |
| 6,135,173 | A | 10/2000 | Lee et al. | |
| 6,267,272 | B1 * | 7/2001 | Shin | 222/505 |
| 6,418,736 | B1 | 7/2002 | Cover | |
| 6,807,814 | B1 | 10/2004 | Otani et al. | |

OTHER PUBLICATIONS

Sub-Zero Design Guide, 3758546 Rev-B, Sep. 2006, 84 pages.

* cited by examiner

*Primary Examiner*—William E Tapolcai
(74) *Attorney, Agent, or Firm*—Foley & Lardner LLP

(57) ABSTRACT

A refrigerator includes an ice dispenser, a discharge chute, and a cover for the discharge chute. A flat portion of the cover conforms to the discharge chute, the flat portion being flexible to a flexed position to actuate a switch and thereby operate the ice dispenser such that ice is discharged into the discharge chute.

13 Claims, 6 Drawing Sheets

INTEGRATED ICE DISPENSER SWITCH

BACKGROUND OF THE INVENTION

The present invention relates generally to the field of refrigerators having ice dispensers, and more specifically, to a refrigerator having a bulk ice dispenser with an integrated switch mechanism.

Many refrigerators manufactured today provide users with the ability to obtain water and/or ice through the door of the freezer or refrigerator compartments such that the water and/or ice may be obtained without the need to open the refrigerator or freezer door and expose the lower temperature compartment to the warmer room temperature of the surrounding environment. However, such "through the door" service is typically suitable only for dispensing relative small amounts of ice (e.g., for a single drinking glass) and is not well suited for dispensing ice in a bulk fashion because of the often limited space available with through the door services.

In order to efficiently dispense ice in bulk quantities, it is often necessary to open the refrigerator or freezer door, where a user may obtain bulk ice via an ice maker or ice dispenser through a discharge chute. In order to actuate the ice dispenser such that ice is discharged from the ice dispenser and through the discharge chute, a separate switching mechanism is typically needed from that used for through the door service.

Many refrigerators providing bulk ice service provide the switch mechanism for the ice dispenser within the refrigerated compartment in the form of, for example, a push button switch attached to a wall portion of the refrigerator compartment, such that bulk ice is dispensed for as long as a user depresses the switch.

One challenge of such bulk ice dispensing units is that the switch may not be aesthetically pleasing and may be unsightly in comparison with the often otherwise "clean" designs of many refrigerators.

Another challenge of typical ice dispensing switches is that the switch may be in an inconvenient location (e.g., located on a sidewall of the refrigerator compartment) where it may be difficult for a person receiving bulk ice to also depress the actuation switch.

Accordingly, it would be advantageous to provide a refrigerator having a bulk ice dispensing unit with an aesthetically pleasing, integrated switch mechanism. It would also be advantageous to provide a refrigerator having a bulk ice dispensing unit with an easily accessible switch mechanism.

Accordingly, it would be advantageous to provide a refrigerator with an ice dispenser that provides one or more of these or other advantageous features or addresses one or more of the above-identified needs. Other features and advantages will become apparent from the present specification. The teachings disclosed herein extend to those embodiments that fall within the scope of the appended claims, regardless of whether they accomplish one or more of the above-identified needs.

SUMMARY

One embodiment relates to a refrigerator assembly comprising a refrigerator compartment having a door moveable between an open position and a closed position, a freezer compartment separated from the refrigerator compartment by a divider wall and having an ice dispenser, a discharge chute coupled to the ice dispenser and located in the refrigerator compartment, the discharge chute configured to direct ice discharged from the ice dispenser, and a cover that covers at least a portion of the discharge chute, the cover comprising at least one panel member that is depressible to actuate an electrical switch for the ice dispenser.

Another embodiment relates to a discharge chute assembly for an appliance comprising a body having a front surface, a switch lever having an outer surface substantially coplanar with the front surface, and an electrical switch coupled to the body and configured to operate an ice dispenser upon actuation. The switch lever is configured to activate the electrical switch.

Yet another embodiment relates to an appliance comprising a dispenser, a discharge chute, and a cover for the discharge chute, wherein a flat portion of the cover conforms to the discharge chute, the flat portion being flexible to a flexed position to actuate a switch and thereby operate the dispenser such that material is discharged into the discharge chute.

The invention is capable of other embodiments and of being practiced and carried out in various ways. Alternative exemplary embodiments relate to other features and combinations of features as may be generally recited in the claims.

BRIEF DESCRIPTION

The drawings will be come more fully understood from the following detailed description, taken in conjunction with the accompanying drawings, wherein like reference numerals refer to like elements, in which:

FIG. 6 is a partial cross-section view of the cover assembly of FIG. 4 according to an exemplary embodiment; and.

DETAILED DESCRIPTION

Figure 1:
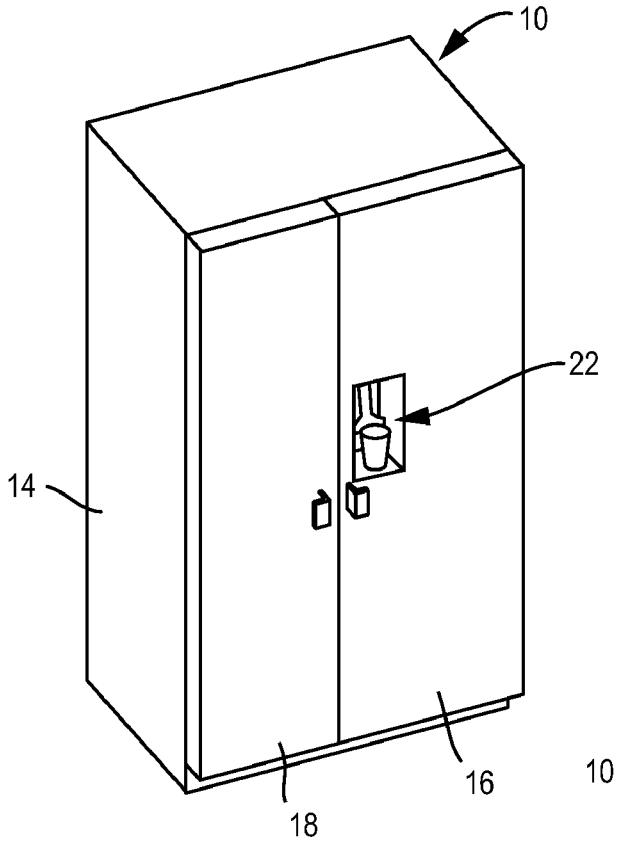
FIG. 1 is perspective view of a refrigerator with the refrigerator door in the closed position according to an exemplary embodiment.
Figure 2:
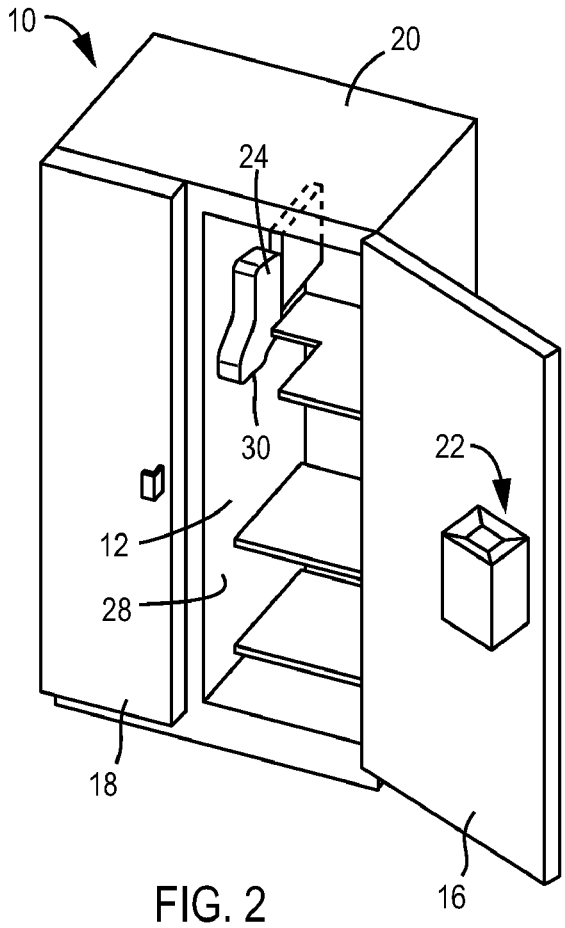
FIG. 2 is a perspective view of the refrigerator of FIG. 1 with the refrigerator door in the open position and having an ice dispenser according to an exemplary embodiment.

Referring to FIGS. 1 and 2, a refrigerator 10 according to an exemplary embodiment is shown. Refrigerator 10 is shown as a side-by-side style refrigerator having a refrigerator compartment 12 and a freezer compartment 14. Refrigerator 10 further includes refrigerator door 16 and freezer door 18, which are pivotally attached to refrigerator body 20 such that each may be moved between a closed position and a variety of open positions. According to various alternative embodiments, refrigerator 10 may be a "top-bottom" style refrigerator, a "chest" style refrigerator, and so on.

According to one embodiment, refrigerator 10 includes a dispenser mechanism 22. As shown in FIGS. 1 and 2, dispenser mechanism 22 is mounted to door 16 of refrigerator compartment 12 and extends from the interior of refrigerator compartment 12 to the exterior of refrigerator 10. Dispenser mechanism 22 permits users to obtain ice and/or water from the refrigerator and/or freezer compartments 12, 14 without having to open doors 16, 18 and expose refrigerated compartment 12 and/or freezer compartment 14 to the typically warmer temperature of the exterior environment. According to one embodiment, dispenser mechanism may include a lever (e.g., a lever conforming to the contour of a drinking glass) or other type of device such that an ice dispenser (not shown) within freezer compartment 14 may be activated and provide ice to a user via dispenser mechanism 22.

Referring further to FIG. 2, refrigerator 10 includes a divider wall 28 that separates refrigerator compartment 12 from freezer compartment 14. A discharge chute assembly 24 is mounted to the refrigeration side of divider wall 28, such that ice pieces may be discharged from the ice dispenser within freezer compartment 14 and travel through wall 28 and discharge chute assembly 24 and exit at end 30 of discharge chute assembly 24. When door 16 is in the closed position, ice pieces travel from the ice dispenser to discharge chute assembly 24 and to dispenser mechanism 22, where the ice is discharged from refrigerator 10 to, for example, an individual drinking glass (see FIG. 1).

According to one embodiment, when door 16 is in an open position, for example, as shown in FIG. 2, ice (e.g., bulk ice) may be dispensed directly from discharge chute assembly 24 without traveling through dispenser mechanism 22. The ice pieces travel from the ice dispenser in freezer compartment 14, through discharge chute assembly 24, and into, for example, a container (not shown) for holding the bulk ice as it is dispensed.

Figure 3:
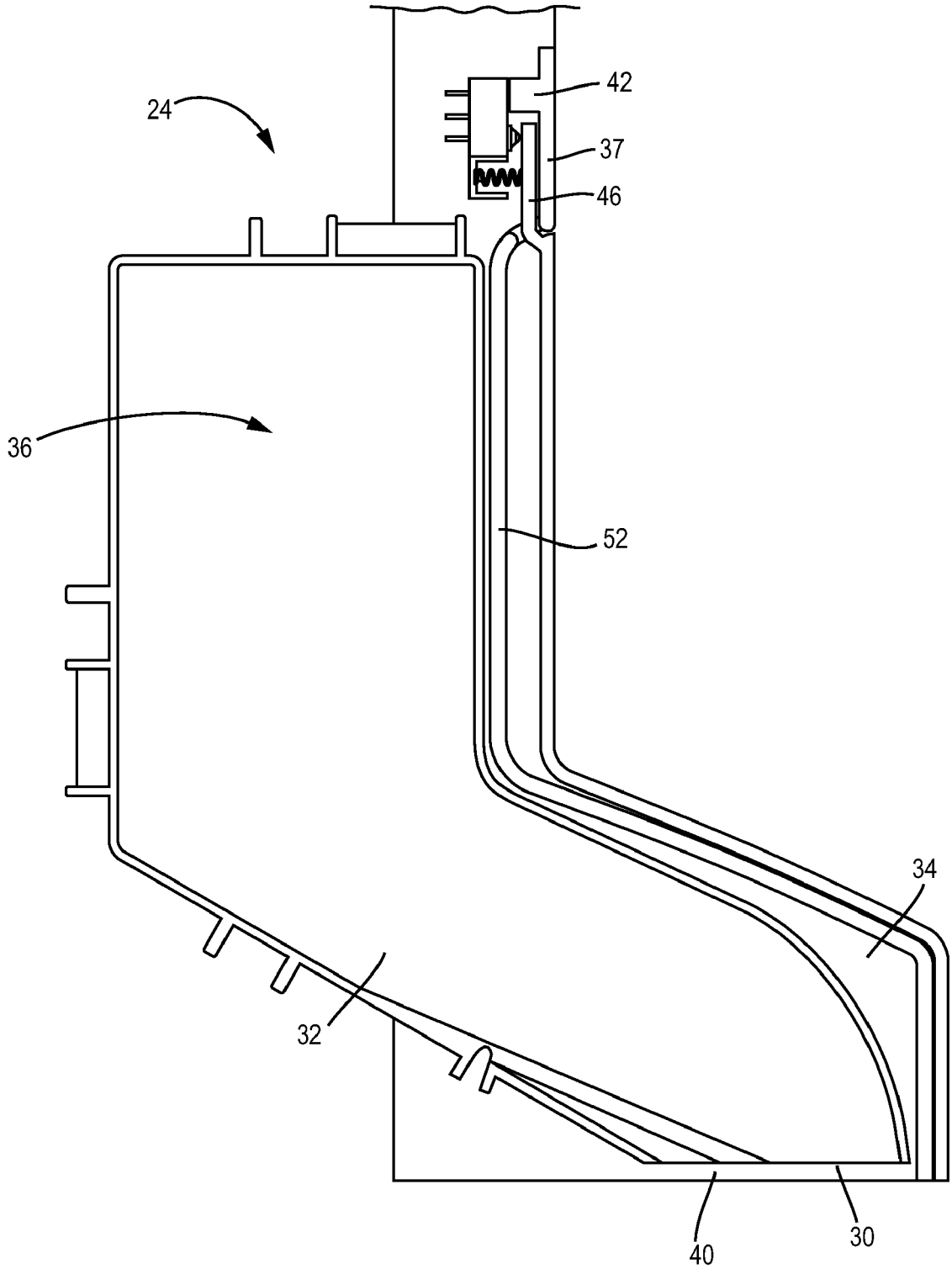
FIG. 3 is a cross section view of the ice dispenser of FIG. 2 according to an exemplary embodiment.

Referring now to FIG. 3, discharge chute assembly 24 according to an exemplary embodiment is shown in greater detail. Discharge chute assembly 24 includes a chute 32 and a cover 34 (e.g., a housing, escutcheon, etc.) Chute 32 receives ice dispensed from the ice dispenser in freezer compartment 14 at an inlet portion 36. The ice travels through chute 32 and is directed toward end 30 of discharge chute assembly 24. Upon exiting end 30, the ice may either be collected directly for bulk usage, or the ice may be dispensed via dispensing mechanism 22 (see FIGS. 1 and 2), for relatively smaller portions of ice.

As shown in FIG. 3, chute 32 is an angled member configured to direct ice from the ice dispenser toward the door portion of refrigerator 10. Various configurations of ice discharge chutes may be used in addition to the configuration shown in FIG. 3. According to one embodiment, chute 32 is a made of a plastic material using an injection molding process. According to various other alternative embodiments, other materials and/or manufacturing processes may be used to manufacture and/or assemble chute 32.

Referring further to FIG. 3, cover 34 has a body 42 with a front portion 37 that generally follows the contour of a front surface 38 of chute 32, and an open portion 40 at end 30 of discharge chute assembly 24. Open portion 40 permits ice dispensed from the ice dispenser to be discharged from discharge chute assembly 24 after traveling through chute 32. According to one embodiment, open portion 40 conforms to a corresponding opening in dispensing mechanism 22 when refrigerator door 16 is in the closed position such that ice may be properly directed to dispensing mechanism 22.

Figure 4:
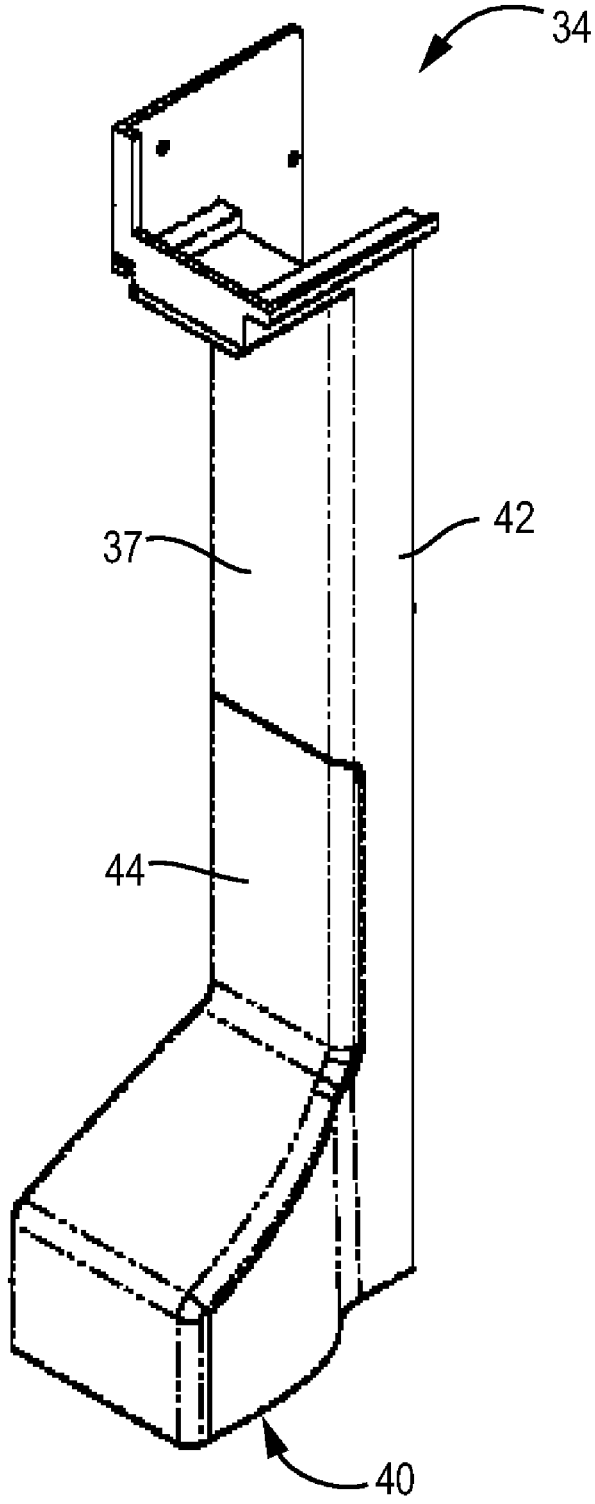
FIG. 4 is a perspective view of a cover assembly according to an exemplary embodiment.

Referring now to FIGS. 4-7, cover 34 according to an exemplary embodiment is shown in greater detail. As shown in FIG. 4, cover 34 includes body portion 42 that covers chute 32 to provide an aesthetically pleasing and attractive appearance for discharge chute assembly 24. According to one embodiment, cover 34 extends from end 30 of discharge chute assembly 24 upward to a ceiling portion or top wall portion of refrigerator compartment 12 (not shown in FIG. 4). Cover 34 includes a switch lever or panel member 44 that also forms a part of the exterior of cover 34.

Figure 5:
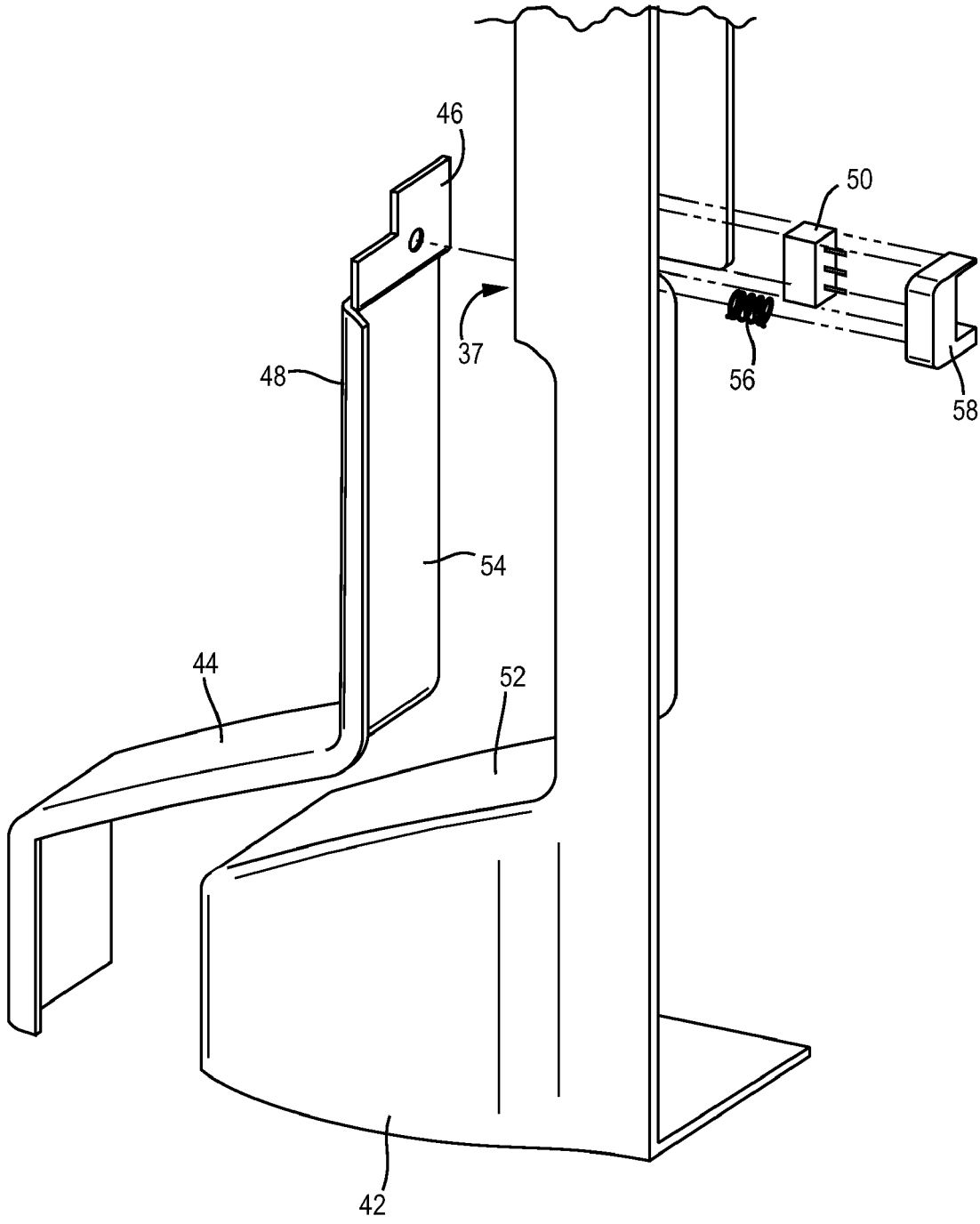
FIG. 5 is a partial exploded view of the cover assembly of FIG. 4 according to an exemplary embodiment.
Figure 6:
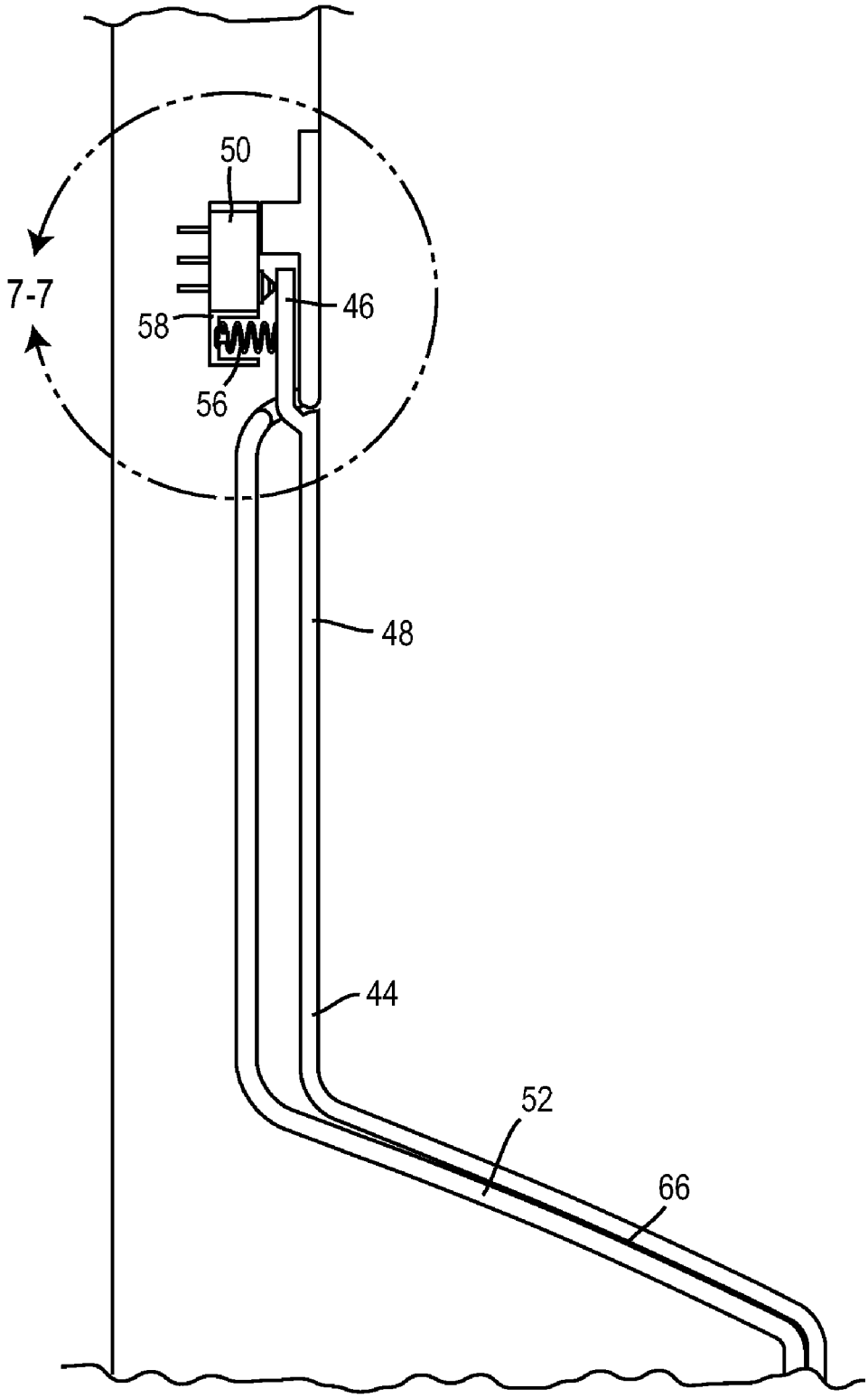

As shown in FIG. 4, lever 44 is a shaped member that generally conforms to the contour of the periphery of body 42. According to an exemplary embodiment, lever 44 is depressible such that a planar portion 48 may be depressed or flexed, causing an end portion 46 of lever 44 to actuate a switch 50 (see FIG. 6). According to various other embodiments, planar portion 48 may be a shaped member having one or more contours. Referring to FIGS. 5 and 6, lever 44 is secured to a recessed portion 52 of cover 34. Recessed portion 52 provides a mounting surface, or backing, onto which lever 44 may be mounted, and is recessed such that lever 44 and front surface 37 of cover 34 provide a smooth and aesthetically pleasing surface when lever 44 is secured to cover 34. According to one embodiment, lever 44 is secured to recessed portion 52 using an adhesive tape 66 (e.g., VHB™ Tape provided by 3M™ of St. Paul, Minn.). Lever 44 is secured to recessed portion 52 such that planar portion 48 may be flexed with respect to front portion 37 of cover 34 and actuate switch 50 (e.g., by depressing a portion of switch 50). For example, lever 44 may be secured to recessed portion 52 using tape 66 such that there is no tape material between planar portion 48 and the upper portion of recessed portion 52, thereby permitting planar portion 48 to be depressed by a user. According to one embodiment, an opening 64 (e.g., gap, space, slot, aperture, etc.) exists between at least a portion of lever 44 (e.g., planar portion 48) and recessed portion 52 (see FIG. 7). Various types of tapes or other adhesives may be used to secure lever 44 to recessed portion 52 according to various alternative embodiments. Further, mechanical fasteners such as screws, bolts, etc. may also be used to secure lever 44 to recessed portion 52. Utilizing a tape material such as tape 66 to secure lever 44 to recessed portion 52 avoids the use of mechanical fasteners and maintains an aesthetically pleasing appearance and the feel of "ice" on cover 34.

According to an exemplary embodiment, lever 44 is made of a clear polycarbonate material, and a rear surface 54 of lever 44 is painted in a white or glossy white finish. According to another embodiment, lever 44 may be manufactured using a white rear surface material (e.g., mylar, etc.), and an injection molding process to form the clear portion (e.g., using an injection molding process, as an in-mold decoration). Other means of manufacturing lever 44 may also be used according to various other alternative embodiments. Once mounted, lever 44 (e.g., the clear polycarbonate material with rear painted surface) provides the appearance of ice (e.g., an ice slab) being on the surface of the cover 34. Further, this "visual feel" of an ice slab overlying cover 34 provides an intuitive suggestion to users that discharge chute assembly 24 provides ice to users.

As shown in FIG. 5, lever 44 is attached to cover 34 via recessed portion 52. According to various alternative embodiments, lever 44 may be attached at a variety of alternative locations on cover 34 that maintain the aesthetic appearance and the functionality of cover 34 and lever 44. For example, lever 44 may be secured to another portion of body 42, such as a sidewall portion.

Figure 7:
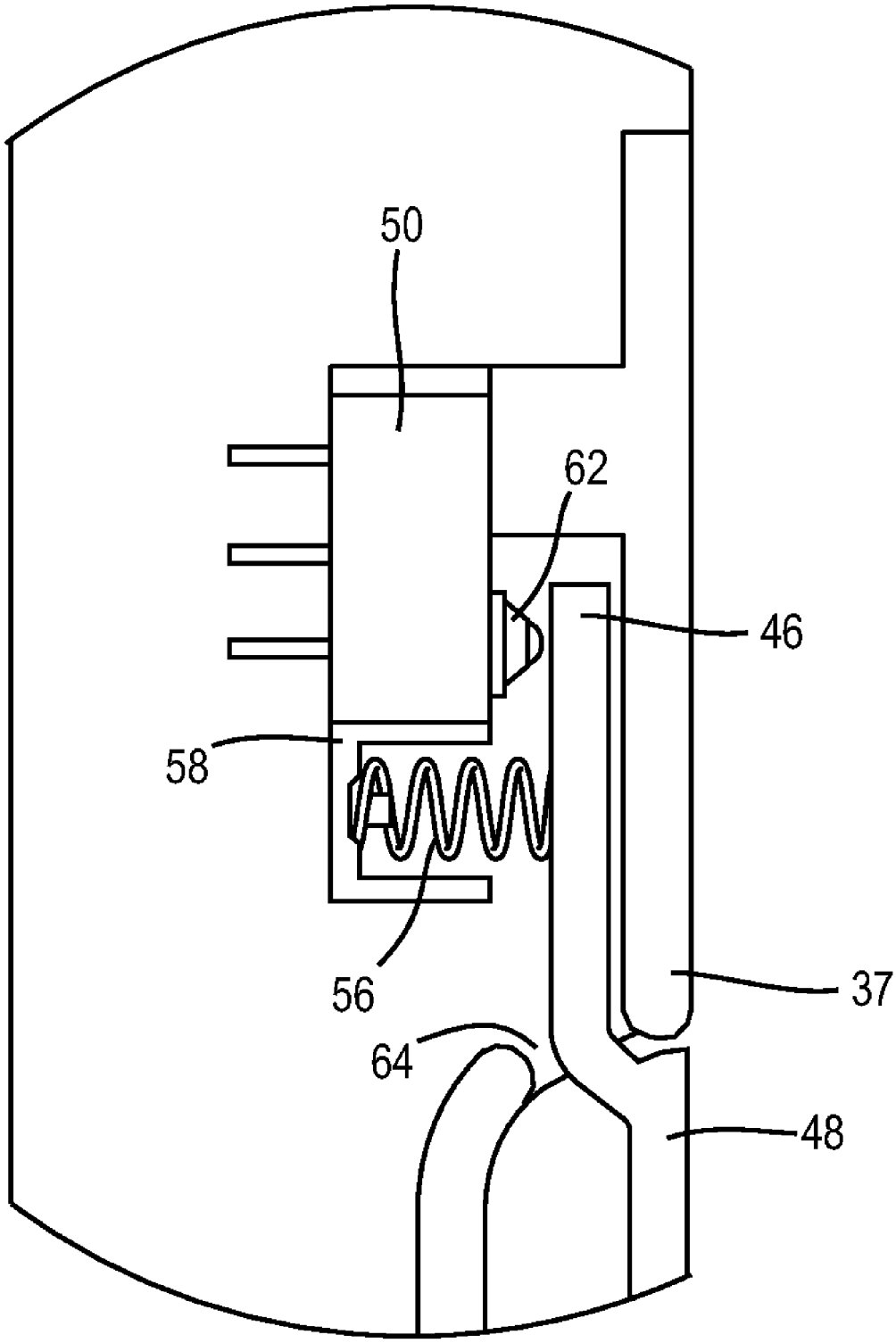
FIG. 7 is a detail view of view of 7-7 of FIG. 6.

According to an exemplary embodiment, switch 50 is a direct circuit (DC) switch that is coupled to the ice dispenser within freezer compartment 14 such that actuation of switch 50 operates the ice dispenser. Referring now to FIGS. 6 and 7, the operation of lever 44 and switch 50 will be described in greater detail. As shown in FIG. 6, end 46 of lever 44 extends beneath front portion 37 of cover 34 such that end 46 is located between the back surface of front portion 37 and switch 50. End 46 is positioned relative to switch 50 such that switch 50 is normally in the off position (e.g., such that the ice dispenser is not operating). Flexing or depression of planar portion 48 causes end 46 to depress button 62 on switch 50, thereby activating switch 50 and operating the ice dispenser. It should be understood that while the electrical connections between switch 50 and the ice dispenser are not shown, any means of effectuating the appropriate electrical connection known to those skilled in the art may be used.

According to an exemplary embodiment, switch 50 is coupled to body 42 of cover 34 via a housing 58. Housing 58 may be made of any suitable material, including various plastic materials. A spring 56 is located within housing 58. According to one embodiment, spring 56 is a coil spring and is intended to resist depression of lever 44 and to provide a force tending to return lever 44 to the normal, or unflexed, position (e.g., such that switch 50 is not actuated by end 46). Other types of springs may alternatively be used according to various other embodiments. Switch 50, lever 44, and spring 56 may be configured such that a user may actuate the switch with a minimal amount of force, thereby easing the effort required to dispense bulk ice. For example, spring 56 may provides a unique feel, or touch, for users of lever 44, similar to that of clicking a computer mouse. Switch 50 and spring 56 may be mounted to or housed within housing 58 using any suitable methods, including fasteners, adhesives, recesses, etc., and the orientation and position of the components may vary from that shown in FIG. 7 according to various alternative embodiments.

As discussed with respect to the FIGURES, cover 34 is a discrete component from discharge chute 32. One advantage of this type of configuration is that a user does not have to physically move chute 32, but only depress lever 44, to activate the ice dispenser. According to an alternative embodiment, cover 34 and chute 32 may be provided as an integral piece (e.g., an injection molded piece, etc.) According to another embodiment, one or more portions of discharge chute 32 and/or cover 34 may be provided as an integral part of refrigerator compartment 12 and/or freezer compartment 14.

Further, while the various embodiments discussed herein are generally directed to a refrigerator, it should be understood that the teachings contained herein may be extended to a wide variety of other refrigerated appliances and other devices. The term "refrigerated appliance" relates to appliances that have a cooled or chilled enclosure, including a combination refrigerator (e.g., cooled storage for fresh foods) and freezer, refrigerator (only), freezer (only), and having any of a variety of configurations or applications (e.g., side-by-side, over-under, under-counter, drawers, icemakers, wine storage, etc.). Further yet, according to various alternative embodiments, the cover and discharge chute assembly may also be used to dispense water in a bulk manner, either as an integrated ice/water dispenser, or as a separate component (e.g., having a similar cover to that discussed herein with respect to the various embodiments).

It is important to note that the construction and arrangement of the information card and holder as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims.

The order or sequence of any process or method steps may be varied or resequenced according to alternative embodiments. In the claims, any means-plus-function clause is intended to cover the structures described herein as performing the recited function and not only structural equivalents but also equivalent structures. Other substitutions, modifications, changes, and omissions maybe made in the design, operating conditions, and arrangement of the exemplary embodiments without departing from the scope of the present inventions as expressed in the appended claims.

What is claimed is:

1. A refrigerator, comprising:

a refrigerator compartment having a door moveable between an open position and a closed position;

a freezer compartment separated from the refrigerator compartment by a divider wall and having an ice dispenser;

a discharge chute located in the refrigerator compartment and coupled to the ice dispenser, the discharge chute configured to direct ice discharged from the ice dispenser;

a cover that covers at least a portion of the discharge chute, the cover including a body portion and at least one panel member;

wherein the at least one panel member is depressible to actuate an electrical switch for the ice dispenser;

and wherein the panel member comprises a planar portion and an end portion, wherein the body portion is located between the planar portion of the panel member and the chute, and the end portion of the panel member is located between the body portion and the chute.

2. The refrigerator of claim 1, wherein the end portion extends through an opening in the body portion to engage the switch.

3. The refrigerator of claim 1, wherein the dispenser is actuated by an application of a force to the planar portion of the panel member which causes a generally linear movement of planar portion of the panel member and a generally linear movement of the end portion of the panel member.

4. The refrigerator of claim 1, further comprising a spring configured to resist depression of the panel member.

5. The refrigerator of claim 1 wherein the discharge chute and the cover are coupled to the divider wall.

6. The refrigerator of claim 1, wherein the panel member is not accessible from the exterior of the refrigerator assembly when the door is in the closed position.

7. The refrigerator of claim 1, wherein the planar portion of the panel member is coplanar with at least a portion of the body portion.

8. An appliance having a freezer compartment and a refrigerator compartment, comprising:

a dispenser;

a discharge chute;

a cover conforming to at least a portion of the discharge chute, the cover including a lever and a body portion;

wherein the lever is coplanar with at least a portion of the body portion and flexible to a flexed position to actuate a switch and thereby operate the dispenser such that material is discharged from the dispenser into the discharge chute;

wherein the dispenser is an ice dispenser configured to operate within the freezer compartment and the discharge chute is configured to operate within the refrigerator compartment; and wherein the lever comprises a planar portion and an end portion, wherein the body portion is located between the planar portion and the discharge chute, and the end portion is located between the body portion and the discharge chute.

9. The appliance of claim 8, wherein the lever is secured to the body portion via a tape material.

10. The appliance of claim 8, further comprising a spring configured to resist flexing of the lever.

11. The appliance claim 10, wherein the spring and the switch are coupled to the cover via a housing.

12. The appliance of claim 8, wherein the lever comprises a clear polycarbonate material having one surface with a white finish.

13. The appliance of claim 11, wherein the spring and the switch are provided to a first side of the lever and the at least a portion of the body portion is provided to a second side of the lever opposite the first side.

* * * * *